United States Patent [19]

Szapucki et al.

[11] Patent Number: 4,951,869

[45] Date of Patent: Aug. 28, 1990

[54] COIN TELEPHONE COLLECTION BOX

[76] Inventors: Mathew Szapucki, 65 Kingsley Rd., Kendall Park, N.J. 08824; Richard Kulkaski, 9 Jonathan Dr., Tinton Falls, N.J. 07724

[21] Appl. No.: 229,345

[22] Filed: Aug. 5, 1988

[51] Int. Cl.[5] ..... G07B 15/00

[52] U.S. Cl. ..... 232/15; 232/16

[58] Field of Search ..... 232/15, 16, 7; 220/229, 220/324, 337

[56] References Cited

U.S. PATENT DOCUMENTS

| | | | |
|---|---|---|---|
| 3,236,408 | 2/1966 | McFadden et al. | 220/337 |
| 3,741,464 | 6/1973 | Verbeke | 232/15 |
| 3,837,566 | 9/1974 | McGough | 232/15 |
| 3,926,366 | 12/1975 | Sciortino | 232/16 X |
| 3,948,376 | 4/1976 | Roman | 232/15 X |
| 4,634,019 | 1/1987 | Pherigo | 220/334 |

*Primary Examiner*—Robert W. Gibson, Jr.
*Attorney, Agent, or Firm*—Horst M. Kasper

[57] ABSTRACT

The invention relates to a telephone coin collection box, to be closed with a cover, for a telephone system. The bottom and the sides of the coin box are made of plastic. A stainless steel staple is attached to the front side for lockingly engaging a cover and triple hinge openings are disposed in the rear side near the straight upper edge. The coin box according to the invention provides high stability against damage during handling and can be manufactured in an inexpensive way. Following drop tests performed on coin boxes, the plastic coin box exhibited a remarkable toughness and showed no distortions and could still fit into the respective compartment of a coin-operated telephone.

14 Claims, 7 Drawing Sheets

FIG. 1
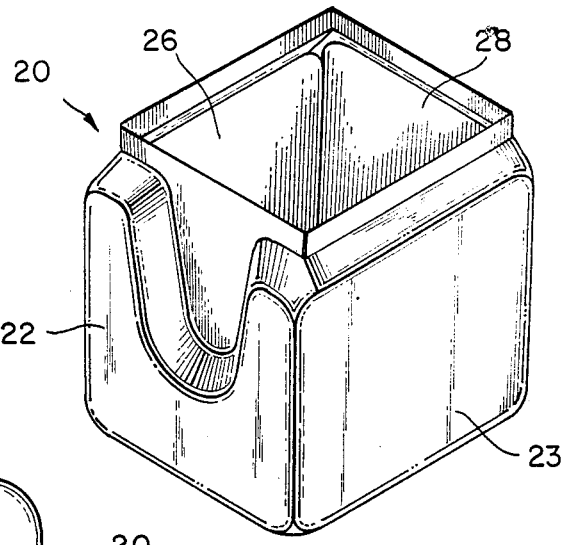
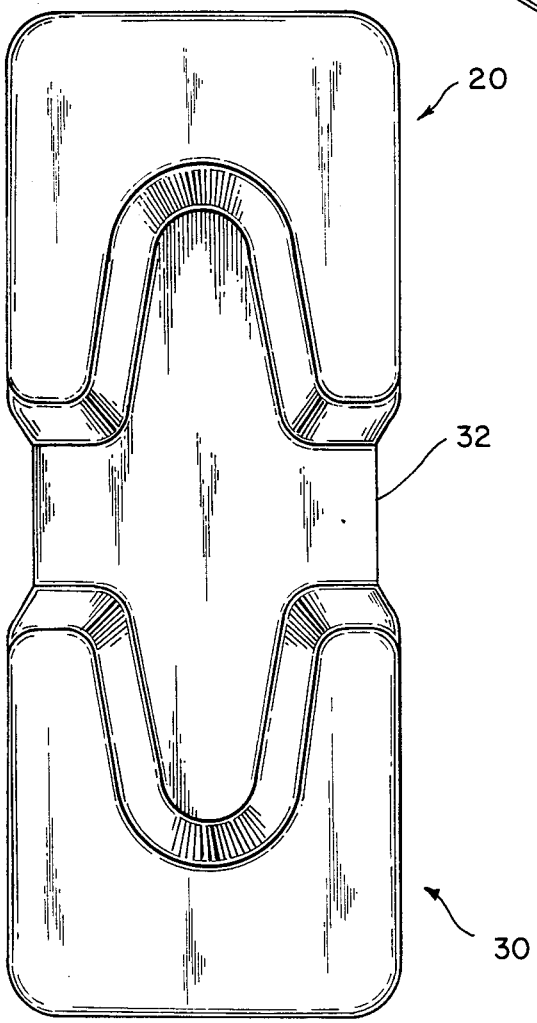
FIG. 2

COIN TELEPHONE COLLECTION BOX

BACKGROUND OF THE INVENTION

1. Field of the Invention

The present invention relates to a coin telephone collection box which can be adapted to standard coin telephone collection covers for a secure and reliable operation of the coin collection in coin telephone systems.

2. Brief Description of the Background of the Invention Including Prior Art

Coin-operated telephones are known for numerous years and these devices include a coin collection box.

U.S. Pat. No. 1,321,156 to H. M. Smeby teaches a telephone coin box and holder. The reference teaches that a holder 10 is provided for the coin box, where the holder 10 may be insulated from the box by means of insulating strips 13. It appears from the description that this telephone coin box does not meet present-day security and collection requirements.

The basic construction of conventional coin collection boxes by American Telephone and Telegraph Co. is based on established standards that most coin boxes are required to meet. These standards include length, width, and height, handle location, and interface with an industry standard cover design. These conventional coin boxes suffer from expensive manufacturing conditions of the formed metal parts and they exhibit a limited stability to problems which can arise during the handling of such coin boxes.

The existence of such American Telephone and Telegraph Co. coin boxes provides a standard for the dimensions of coin boxes and any new coin box would be required to meet these standards and, furthermore, to accept the standard coin box top in a useable manner. Thus, a duplication of the interface of an existing metal box construction with the existing top cover construction would be required.

The cover for such coin boxes generally includes a bracket which is set. The bracket is set in the open box upon insertion into the telephone. A lever opens an opening for allowing coins to fall through the cover into the box. Upon removal from the telephone, the lever closes the hole and locks.

Conventional coin boxes require that the catch for the pad lock has to be riveted in at additional cost.

The cover for the coil box has to be capable of being removed by a one-hand snapping action. Furthermore, a smooth closing is required.

SUMMARY OF THE INVENTION

1. Purposes of the Invention

It is an object of the present invention to provide a coin collection box for a telephone system which provides high stability against damage during handling.

It is a further object of the present invention to provide a coin collection box which can be manufactured in an inexpensive way while exhibiting exceptional toughness.

It is yet a further object of the present invention to provide a coin collection box which is distinguished by exceptional handling and economy under operating conditions.

These and other objects and advantages of the present invention will become evident from the description which follows.

2. Brief Description of the Invention

The present invention provides for a telephone coin collection box to be closed with a cover comprising a substantially flat bottom side. A front side is imperviously attached to the bottom side and has a straight upper edge at an upper edge level. Means are attached to the front side for lockingly engaging a cover. A left side is imperviously attached to the bottom side and to the front side and has a straight upper edge at the upper edge level. A right side is imperviously attached to the bottom side and to the front side and has a straight upper edge at the upper edge level. A rear side is imperviously attached to the bottom side and to the right side and to the left side and has a straight upper edge at the upper edge level. Triple hinge openings are disposed in the rear side near the straight upper edge.

The means attached to the front side can be a staple. The staple ends can be embedded into the wall of the coin box. The staple ends can be twisted to be lockingly surrounded by a plastic material for preventing twisting of the staple under use conditions.

The front side can comprise an upper substantially flat section and a lower substantially flat section such that the upper flat section can provide a top opening narrower than the lower part of the coin box. The staple can be fixed to the upper substantially flat section and does not protrude beyond a plane passing through the lower substantially flat section. The staple can be made of stainless steel. The eye of the staple can be disposed in a vertical plane.

The bottom and the sides of the telephone coin collection box can be made of plastic.

The telephone coin collection box filled with coins can be stable to a drop from a level of about 10.8 meters.

The triple hinge openings can be provided by a metal strip having three openings. Said metal strip can be substantially disposed in a vertical plane and be supported by plastic material. The metal strip can be of horizontally elongated rectangular configuration. The edge of the metal strip toward the outside of the box can be covered with plastic. Said metal strip can be held on the inside of the telephone coil collection box by two bridges of plastic material disposed between, in each case, two neighboring openings. The metal strip can be further held on the inside of the box by a plastic cover disposed on two short edges at the respective ends of the strip. Said metal strip, below the openings on the side toward the interior of the box, can be substantially blank and free from plastic.

Preferably, the edges between the walls are curved with a radius of curvature corresponding to from about 0.07 to 0.1 times the height of the box.

A method for production of a telephone coin collection box according to the present invention comprises the following steps. A mold is formed for molding two boxes having their upper ends, to be open, connected. A metal strip, having three elongated holes disposed along a line parallel to the elongation of the strip, is placed into the mold, one strip for each of the two boxes to be fabricated, and each metal strip is held in position with a respective magnet. A metal staple is placed into the mold, one for each of the two boxes, and each staple is held in position with a respective magnet on a side of the mold opposite to the side of the mold where the metal strip for the same coin box is held. A molten plastic material is placed into the mold. The plastic material disposed in the mold is cured. The mold is opened and the cured plastic material is removed from the mold. The cured plastic material is finished into a coin box.

The coin box can be machined for removing plastic material disposed on top of the spaces of the metal strip between two neighboring elongated holes on the inside of the coin box.

The coin collection box of the present invention by far exceeds the performance of metal boxes as determined in various drop tests, which are employed as main criteria of box performance. The construction of a plastic coin collection box in contrast to a metal collection box is not of the same type of construction. In particular, the area across the top back of the coin collection box requires great strength far beyond what a straight plastic pipe could give and such an area has to withstand thousands of openings and closings of the metal top. Such operation would produce wear on a plastic part and lead to a box failure, where a simple plastic box would be employed. Strength and wear resistance are to be provided not only by themselves but furthermore there is a dimensional adaptation requirement to the interface with the existing standard collection box top. The coil collection boxes of the invention can be produced by using standard blow molding techniques including construction of the back bracket. Excessive plastic material at the interface area then has to be removed to allow for clearance for the three locking fingers of the cover. The placement of the metal bracket as well as the construction of the clearance area for the fingers results in a surprising capability and reliability.

The staple in the front of the box is required to be constructed such that the cover locks to the box. This staple is also provided by molding an insert using a specific construction so that the staple cannot be pulled or twisted out of the surrounding plastic material. The combination of molding around the staple as well as molding around the back support bracket allows to provide an economical construction and a superior coin telephone collection box.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 1 is a perspective view of the coin collection box,

FIG. 2 is a view of the molded starter piece for producing a coin collection box.

DESCRIPTION OF INVENTION AND PREFERRED EMBODIMENT

Figure 4:
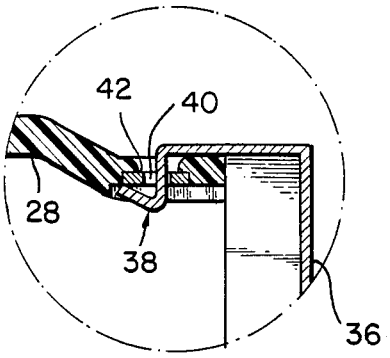
FIG. 4 is a sectional view of the hinge arrangement of the fingers of the cover at the coin collection box.

The coin collection box, generally designated as 20, includes a front side 22, a right side 24, a left side 26, and a rear side 28. The front side has, as can be seen from FIG. 1, the outer diameter of the sides of a smaller diameter at the top as compared to the lower part of the sides. The narrower region has a height of about 1/12 of the overall height of the sides. Over another adjoining twelfth of the height level, the upper section expands to the level of the lower section for the two side walls and the rear wall and for the corner regions of the front wall. In the center region of the front wall, the narrower area extends straight downward for about 0.5 to 0.6 of the total height of the front wall. The width of the front wall upper part coming down is from about 0.2 to 0.3 of the height of the box followed by a graded bevelled area joining the level of the lower part of the front wall. The positional distance difference between the upper and the lower sections of the front wall is from about 0.07 to 0.1 of the height of the front wall, from about 0.05 to 0.07 for the side wall, and from about 0.02 to 0.04 for the rear wall.

Referring now to FIG. 2, there is shown the wall shape obtained after the blow molding process from which two coin boxes 20, 30 can be produced. The coin boxes 20, 30 are joined at a middle section 32 which is removed in order to separate and open the coin boxes 20, 30.

Figure 3:
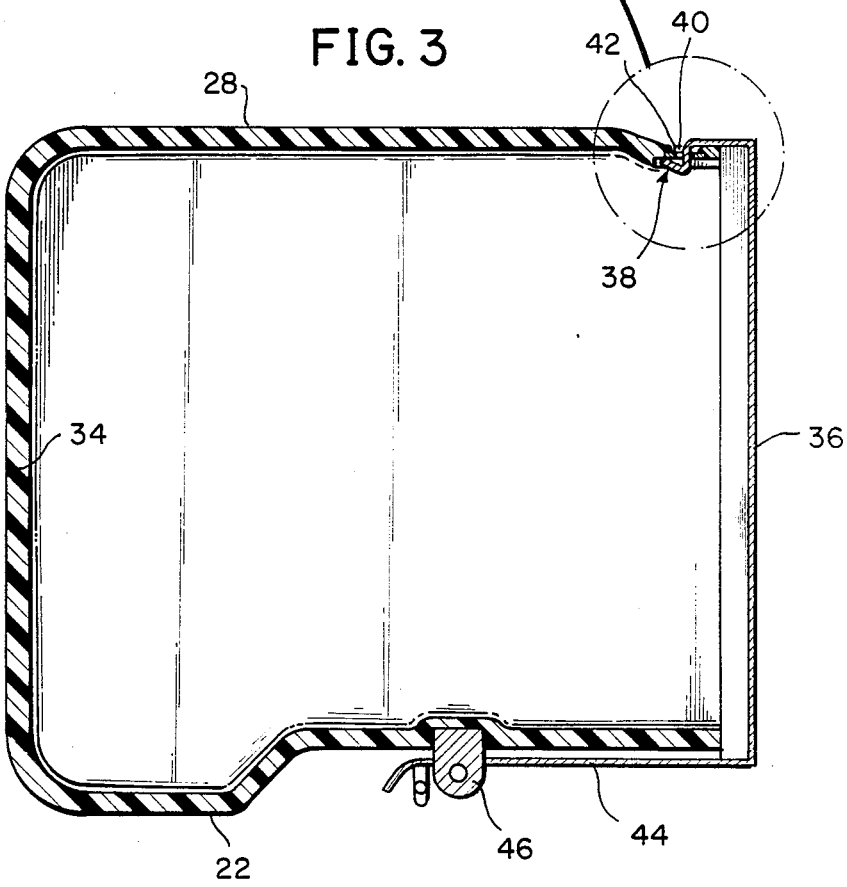
FIG. 3 is a sectional view of the coin collection box including a cover and its attachment sections.

FIG. 3 illustrates in a sectional view the rear wall 28, the bottom 34, and the front wall 22. A cover is schematically indicated at 36. The cover extends in its rear section into fingers 38 which are hingedly placed into holes 40 positioned in a metal strip 42 (FIG. 4). The holes, together with the fingers 38, allow a hinged opening of the cover where the holding hinge angle is at least about 20 degrees. The center of the metal strip and, respectively, of the holes can be from about 0.04 to 0.06 times the height of the coin box from the upper edge of the coin box. The cover is provided with a hasp 44 disposed near the front side of the coin box. The hasp 44 engages a staple 46. The padlock can be placed through a hole of the staple 46 to lock the hasp 44 in position.

As can be seen in FIG. 3, the metal staple 46 is embedded in the plastic of the front section of the coin box. The thickness of the plastic material in the area of the staple protrudes toward the inside corresponding to from 0.5 to 1 times the thickness of the enclosed support parts of the staple in the molded box.

Figure 5:
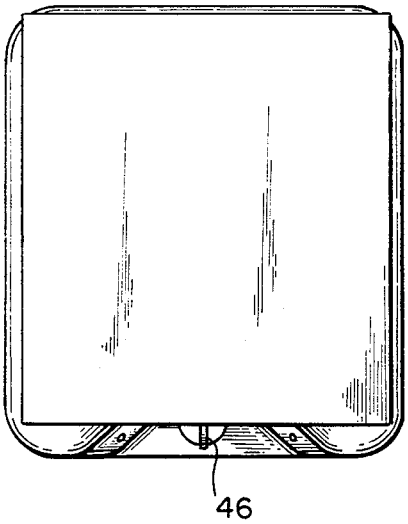
FIG. 5 is a top view of the coin collection box.

FIG. 5 illustrates a top view of the coin box indicating the position of the staple 46 and the area where the upper section of the front side changes into the wider lower part of the coin box on the four sides.

Figure 6:
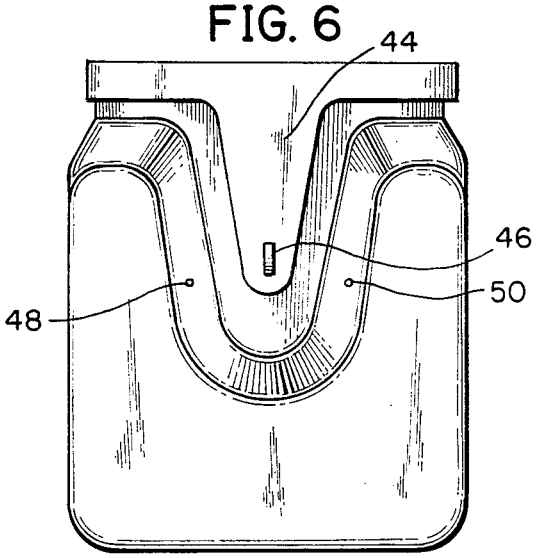
FIG. 6 is a front side view of the coin collection box.

FIG. 6 is a front view and clearly indicates the position of the staple relative to the remaining parts of the front sides. In addition, the positions of the holes 48 and 50 for supporting a handle are clearly indicated in FIG. 6. In the front view illustration of FIG. 6, the schematic cover is illustrated in position together with the hasp 44 engaging the staple 46.

Figure 7:
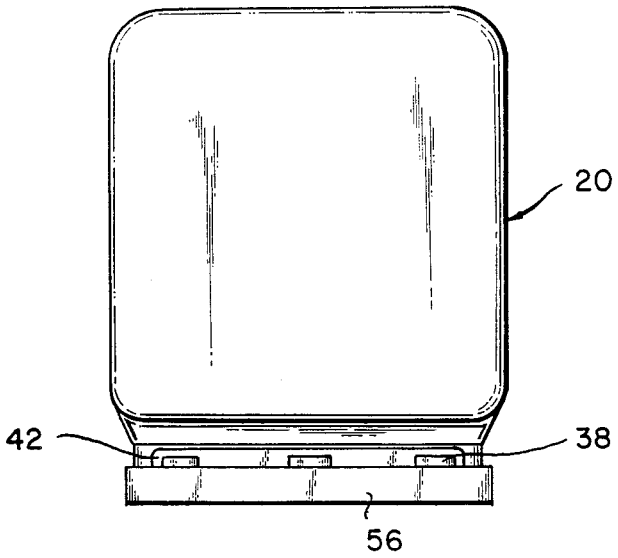
FIG. 7 is a rear elevational view of the coin collection box.

FIG. 7 illustrates a rear view of the coin box together with a schematic cover rear section 56. The rear section 56 has attached fingers 38, and in particular three fingers symmetrically disposed relative to a middle symmetry line of the rear side. The fingers 38 engage the metal strip 42 embedded into the plastic of the rear side. As can be seen from FIG. 2, the lower front part and the upper rear part of the metal plate are free from plastic in order to allow the rear section and the fingers of the cover plate to move for allowing opening of the cover plate.

Figure 8:
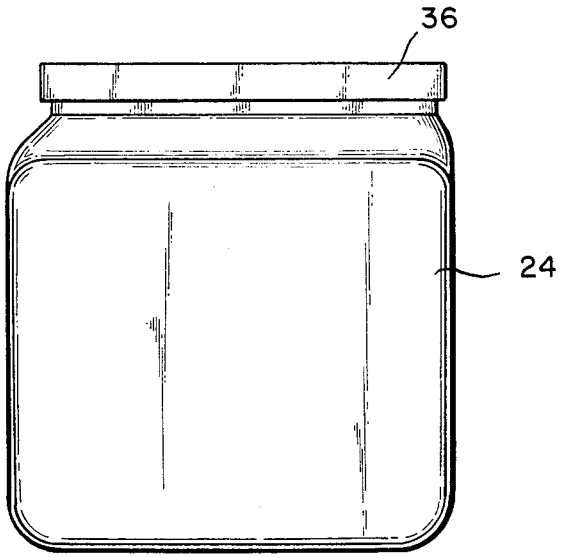
FIG. 8 is a side elevational view of the coin collection box.

FIG. 8 illustrates a side view of the coin box together with the cover plate 36. It can be recognized that the lower part of the front side protrudes much further versus the upper half of the front side as compared to the respective protrusion occurring on the rear side. Furthermore, the area where the transition from the narrower upper part to the wider lower part occurs is recognizable.

Figure 11:
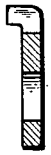
FIG. 11 is a first sectional view of the coin of the locking staple eye.
Figure 10:
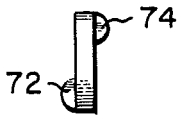
FIG. 10 is a front elevational view of the locking staple eye.
Figure 9:
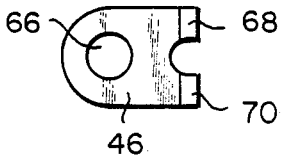
FIG. 9 is a view of the front lock eye of the coin collection box as viewed from the side.
Figure 12:
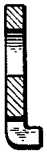
FIG. 12 is a second sectional view of the locking staple eye.

FIG. 9 illustrates a side view of the staple 46 with a hole 66 for positioning a lock. The ends 68 and 70 of the staple are positioned into the molded plastic. FIG. 10 illustrates a front view of the staple together with protrusions 72 and 74 adjoining the end sections 70 and 68 of the staple, respectively. These protrusions can be further recognized in FIGS. 11 and 12, which illustrate an in part sectional view of the staple 46.

Figure 13:
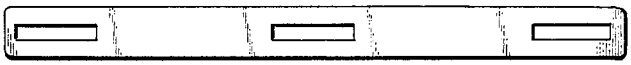
FIG. 13 is a plan view onto the hinge bracket metal plate.

FIG. 13 illustrates the shape of the metal plate embedded into the plastic together with the openings provided therein. The openings are disposed at equal distances and the metal plate has a width which corresponds to from about 2.5 to 5 times, and preferably from 2.8 to 3.5 times the diameter of the holes in the same direction. The holes are of elongated shape to allow positioning of the fingers through the holes and a hinge action. The elongation direction of the holes is parallel to the elongation direction of the plate. The distance between two holes is from about 1.5 to 3 times the length of the holes and preferably from about 1.8 to 2.2 times the length of the holes.

Figure 14:
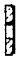
FIG. 14 is a sectional view of the hinge metal plate in the area of an opening.

FIG. 14 illustrates a cross-section through the plate at the position for intersecting one hole of the metal plate.

Figure 15:
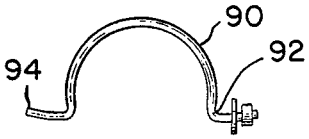
FIG. 15 is an elevational view of the jug of a handle.

FIG. 15 shows a handle 90 having ends 92 and 94. These ends 92 and 94 can be placed through the holes 48 and 50 of the front side and allow a tilting motion of the handle around its ends 92 and 94 in said holes 48 and 50.

Figure 16:
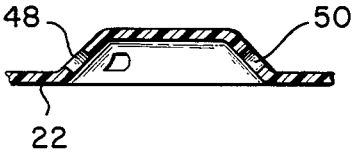
FIG. 16 is a sectional view through the front of the coin box at the level of the hole openings for the handle.

As can be recognized in FIG. 16, the holes are disposed in an area of the front side where there occurs the transition from the width defined by the upper section to the width defined by the lower section.

Figure 17:
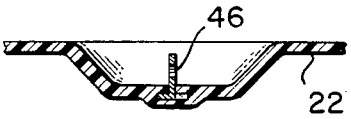
FIG. 17 is a sectional view through the front of the coin collection box at the level of the locking eye.

FIG. 17 illustrates the position of the staple 46 relative to the front wall 22 and shows that the staple is disposed between the front level defined by the upper section and the front level defined by the lower section. The staple protrudes by about 0.6 to 0.9 times the width of the transition region between the upper section of the front side and the lower section of the front side. The metal plate is held by plastic which surrounds in a uniform fashion the outer edges of the metal plate on the rear side. In contrast, in the area between the holes, the metal plate is fully embedded into the plastic as well as at the rear ends. Thus, the metal plate is held on the outer side by a surrounding section of molded plastic and on the inner side by strips covering the metal plate at both sides of the holes in horizontal direction. The plastic material is removed on the inner side between these covering strips such that the metal strip is flush with the plastic in the area of the fingers of the cover in order to allow a free motion of the cover. The outside corners of the box are rounded, where the radius of curvature of the rounding corresponds to 0.07 to 0.1 times the height of the box. The side walls and the bottom have in their center a seam caused by a mold made from two parts, which corresponds to the front and the rear side of the coin box.

The coin telephone collection box according to the invention can be produced by standard blow molding techniques. The blow molding machine drops a hollow parison of plastic material, which is then encapsulated by the mold. Air or an inert gas is injected into the parison causing the parison to press outward and to conform on its outer surface to the shape of the mold.

For producing the coin telephone collection box according to the invention, the two steel parts are inserted at a special holder in the mold before the parison is encapsulated.

The metal staple is suspended in the side wall of the mold. The plastic material flows around the metal staple during the blowing process. The metal staple is formed to provide strength against direct pull-out and is provided with protrusions for protection against twisting.

To hold the cover in a hinged way, a metal support is provided in the back of the coin box. Preferably, this metal support is a punched metal plate made of sheet metal stainless steel. The edges of the metal plate are preferably rounded. The plastic material is pushed from the inside out and can totally encapsulate the metal. The thickness of the material as applied is controlled by the tube thickness employed in the blow molding process.

During the blow molding, the metal plate is supported in the mold with magnetic pins. The mold is then closed and the thermoplastic material is forced around the steel parts during the process. Preferably, the molding is performed at a part which is later separated into two separate coin boxes, where the coin boxes are stacked on top of each other, one facing up and one facing down, during the manufacturing process. The two coin boxes are connected at their tops which allows for the formation of a hollow tube, sealed at both ends, to be pressurized from the inside by a needle that is inserted into the center and injected with air pressure. This method allows for an economical production of two coin collection boxes during each cycle. The wall thickness of the coin box can be about 0.65 inch.

The mold allows to fix the geometrical relation of the staple versus the rear support. The mold includes pins held by magnets for supporting the metal bar. The magnets are insufficiently strong to hold molded material.

After cooling of the part, it is removed from the mold and the same cycle is started over with the mold. The part is taken out of the mold and routed on top around the holes for the cover support.

Minimal trim scrap is generated and an easy processing results in the following steps. The two coin boxes, stacked on top of each other, are later cut in half where the two boxes had been joined and secondary operations of routing material, that had run into the brace area, follow to allow for clearance and drilling holes for a handle. The material around the plastic plate is in part stepped down and routed out of the lower inside below the support strip. Holes are bored through the plastic to provide places to support a handle. The mold comes together from two pieces in the center, thus resulting in a parting line.

The employment of plastic materials further enables the products to be permanently identified by hot stamping on any side with a serial number or a bar code.

The standard blow molding process is preferred, where low start-up costs are desired. Various other processes can be used to obtain the invention products, including injection blow molding, straight injection molding, rotational molding. These processes are commonly used in the plastics industry, but other forms of processing plastics can be used where such processes result in molded and controlled formed products.

Thermoplastics are the preferred material to be used in the manufacture of these coin collection boxes. Numerous commercial suppliers and grades of thermoplastic material can be used to produce the box. The requirements to the material employed include high impact resistance at both elevated temperature and at below freezing temperature. An industry standard requires that the material used to construct the box will not fail at −40° below zero. This, however, is not an absolute requirement necessary for the material employed. Certain users of the coin boxes may require more or less impact resistance. A further requirement relates to stiffness and dent resistance. The specific numerical requirements relating to these properties again depend on end-user requirements.

Additional requirements for the materials used include that the back brace, the staple, and the handle are corrosion-resistant, that they provide sufficient strength and wear resistance.

The preferred material according to the invention is polycarbonate-polyester, such as marketed by the General Electric Corporation under the Xenoy name. The material can be provided in pellet form, which pellets are melted at a temperature from about 500° to 600° F. The material is extruded in tube shape in a plastic state at about 500° F. and a cold mold is placed around the tube. The tube can be pressurized inside to pressures of about 300 psi.

EXAMPLE 1

Plastic coin boxes were tested as compared to an industry standard American Telephone and Telegraph Company coin box. The tests involved filling the box with a mixture of U.S. coins that would be used in a pay-telephone, including 5-cent, 10-cent, and 25-cent coins, securing a top on the coin box and dropping the box from various heights at various temperatures. The criteria for an acceptable box, determined by the drop test, included that the box maintain its shape and dimension such that it could be again inserted into an opening in a coin telephone. Furthermore, the box should not reflect any cracks or splits that would allow removal of coins through those cracks and splits and, furthermore, that the top of the box would remain in place and be capable of being removed and reattached.

First tests were performed on the American Telephone and Telegraph Company box to determine from what height the box could be dropped and still meet the above criteria. It was found that, depending on the point of impact, the box would survive anywhere between a three and five-foot high drop. In some cases, if the box had an impact point along a side corner, then the box would not survive one drop from a three-foot height level. The result of the drop would damage the box by distorting the shape sufficiently to allow coins to be removed from the interface area between the top and the box. If the American Telephone and Telegraph Company metal box had an impact point other than a side or a corner, it would survive two or three drops from five feet before it distorted sufficiently so as not to fit into a compartment of a telephone for a coin box. These test results on an American Telephone and Telegraph Company rmetal box are consistent with the tests which have been performed by some telephone companies.

The plastic coin boxes according to the invention were subjected to a similar test. The plastic coin boxes according to the invention show, after repeated drops from a five-foot height level, at temperature ranges from −40° to 120° F., no distortion or bursting occurring on any of the samples. The plastic coin boxes were test-dropped from a twelve-foot level at the same temperatures and they did not show any cracking or bursting after repeated drops. If the coin box had an impact point directly on a lower corner, some distortion would occur. However, dimensionally, the plastic coin box would still fit into the respective compartment of a coin-operated telephone.

It will be understood that each of the elements described above, or two or more together, may also find a useful application in other types of coin boxes differing from the types described above.

While the invention has been illustrated and described as embodied in the context of a telephone coin collection box, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A telephone coin collection box to be closed with a cover comprising a substantially flat bottom side;

a front side imperviously attached to the bottom side and having a straight upper edge at an upper edge level;

means attached to the front side for lockingly engaging a cover;

a left side imperviously attached to the bottom side and to the front side and having a straight upper edge at the upper edge level;

a right side imperviously attached to the bottom side and to the front side and having a straight upper edge at the upper edge level;

a rear side imperviously attached to the bottom side and to the right side and to the left side and having a straight upper edge at the upper edge level;

triple hinge openings disposed in the rear side near the straight upper edge.

2. The telephone coin collection box according to claim 1, wherein the means attached to the front side is a staple, wherein the staple is tongue-shaped with a hole for positioning of a lock, and wherein the tongue-shaped staple comprises two end sections at the bottom of the staple, where the two end sections are extended by protrusions disposed perpendicular to the tongue-shaped staple, and where the protrusions are directed oppositely to one another.

3. The telephone coin collection box according to claim 2, wherein the end sections with the protrusions of the staple are embedded into the wall of the coin box.

4. The telephone coin collection box according to claim 2, wherein the end sections with the protrusions of the staple are twisted to be lockingly surrounded by a plastic material for preventing twisting of the staple under use conditions.

5. The telephone coin collection box according to claim 2, wherein the front side comprises an upper substantially flat section and a lower substantially flat section such that the upper flat section provides a top opening narrower than the lower part of the coin box, and where the staple is fixed to the upper substantially flat section and does not protrude beyond a plane passing through the lower substantially flat section.

6. The telphone coin collection box according to claim 2, wherein the staple is made of stainless steel.

7. The telephone coin collection box according to claim 2, wherein the hole of the staple is disposed in a vertical plane.

8. The telephone coin collection box according to claim 2, wherein the bottom and the sides of the telephone coin collection box are made of plastic.

9. The telephone coin collection box according to claim 1, wherein the telephone coin collection box filled with coins is stable to a drop from a level of about 10.8 meters.

10. The telephone coin collection box according to claim 1, wherein the triple hinge openings are provided by a metal strip having three openings, where the metal strip is substantially disposed in a vertical plane and where the metal strip is supported by plastic material.

11. The telephone coin collection box according to claim 10, wherein the metal strip is of horizontally elongated rectangular configuration, and where the edge of the metal strip toward the outside of the box is covered with plastic, and where the metal strip is held on the inside of the telephone coin collection box by two bridges of plastic material disposed between, in each case, two neighboring openings.

12. The telephone coin collection box according to claim 11, wherein the metal strip is further held on the inside of the box by a plastic cover disposed on two short edges at the respective ends of the strip.

13. The telephone coin collection box according to claim 11, wherein the metal strip below the openings on the side toward the interior of the box is substantially blank and free from plastic.

14. The telephone coin collection box according to claim 1, wherein the edges between the walls are curved with a radius of curvature corresponding to from about 0.07 to 0.1 times the height of the box.

* * * * *